US005576749A

United States Patent [19]

Mochizuki et al.

[11] Patent Number: 5,576,749

[45] **Date of Patent: *Nov. 19, 1996**

[54] INK-JET RECORDING APPARATUS AND INK TANK CARTRIDGE THEREFOR

[75] Inventors: Seiji Mochizuki; Kuzuhisa Kawakami; Masahiro Nakamura; Keiichi Ohshima; Masanori Yoshida, all of Suwa, Japan

[73] Assignee: Seiko Epson Corproation, Tokyo, Japan

[ * ] Notice: The term of this patent shall not extend beyond the expiration date of Pat. No. 5,488,936.

[21] Appl. No.: 422,971

[22] Filed: Apr. 17, 1995

Related U.S. Application Data

[63] Continuation of Ser. No. 928,936, Aug. 11, 1992, which is a continuation-in-part of Ser. No. 742,529, Aug. 7, 1991, Pat. No. 5,255,019, which is a continuation of Ser. No. 642,761, Jan. 18, 1991, Pat. No. 5,070,346.

[30] Foreign Application Priority Data

| | | | |
|---|---|---|---|
| Jan. 28, 1992 | [JP] | Japan | 4-12834 |
| Feb. 19, 1992 | [JP] | Japan | 4-32226 |
| Mar. 16, 1992 | [JP] | Japan | 4-58151 |
| Jun. 26, 1992 | [JP] | Japan | 4-193402 |

[51] Int. Cl.[6] ..... B41J 2/175

[52] U.S. Cl. ..... 347/86

[58] Field of Search ..... 347/86, 87, 92, 347/93

[56] References Cited

U.S. PATENT DOCUMENTS

| | | | |
|---|---|---|---|
| 4,999,652 | 3/1991 | Chan | 347/86 |
| 5,070,346 | 12/1991 | Mochizuki et al. | 347/7 |
| 5,119,115 | 6/1992 | Buat et al. | 347/86 |
| 5,182,581 | 1/1993 | Kashimura et al. | 347/87 |
| 5,231,416 | 7/1993 | Terasawa et al. | 347/23 |
| 5,244,092 | 9/1993 | Karita et al. | 206/462 |
| 5,279,410 | 1/1994 | Arashima et al. | 206/45.14 |

FOREIGN PATENT DOCUMENTS

| | | |
|---|---|---|
| 50-74341 | 6/1975 | Japan . |
| 55-166267 | 12/1980 | Japan . |
| 59-68985 | 5/1984 | Japan . |
| 2-187364 | 7/1990 | Japan . |
| 3-92356 | 4/1991 | Japan . |
| 3-61592 | 9/1991 | Japan . |

*Primary Examiner*—Benjamin R. Fuller
*Assistant Examiner*—Craig A. Hallacher
*Attorney, Agent, or Firm*—Stroock & Stroock & Lavan

[57] ABSTRACT

An ink tank cartridge is provided removably mountable onto an ink supply needle of the ink-jet type recording apparatus body. The cartridge has a housing provided with an ink supply port extending through and projecting from a wall of the housing and into the chamber of the housing. A porous member having ink impregnated thereon is positioned inside the chamber of the housing abutting against the ink supply port. A filter is mounted on the inner end opening of the ink supply port. The ink tank cartridge is further provided with a packing member for resiliently abutting against the outer periphery of the ink supply needle and is positioned adjacent one end of the ink supply port. The outer opening of the ink supply port is sealed with a sealing member through which the ink supply needle penetrates. A further porous member may be positioned in the ink supply port between the packing member and the filter to prevent a false ink end indication caused by air reaching an electrode of an ink end sensor positioned between the filter and the further porous member when the ink tank cartridge is removed from the recording apparatus.

69 Claims, 9 Drawing Sheets

INK-JET RECORDING APPARATUS AND INK TANK CARTRIDGE THEREFOR

This is a continuation of currently pending application Ser. No. 07/928,936, filed on Aug. 8, 1992, entitled INK-TANK RECORDING APPARATUS AND INK TANK CARTRIDGE THEREFOR which is a continuation-in-part application of application Ser. No. 742,529, filed Aug. 7, 1991 entitled INK NEAR-END DETECTION DEVICE, which issued as U.S. Pat. No. 5,255,019, which is a continuation of application Ser. No. 642,761, filed Jan. 18, 1991 entitled INK NEAR-END DETECTING DEVICE, which issued as U.S. Pat. No. 5,070,346 on Dec. 3, 1991.

BACKGROUND OF THE INVENTION

This invention relates generally to an ink-jet type recording apparatus for ejecting ink droplets onto a recording medium, and more particularly, to a structure of an ink tank cartridge for use in a ink-jet type recording apparatus.

In a conventional recording apparatus, ink is supplied to a recording head from an ink tank constructed as a cartridge. The benefits of using an ink cartridge serving as an ink tank is that ink does not smear due to the leakage of ink while refilling new ink or the like. However, undesired air bubbles easily enter the ink tank which cause problems such as an ink failure.

In order to prevent air bubbles from entering the ink tank, several techniques have been proposed. For example, Unexamined Japanese Patent Application (OPI) No. Hei. 3-92356 discloses an ink-jet recording apparatus in which an ink supply port is disposed below an ink tank. The tank is formed with a rubber tap and a metal ink supply needle which penetrates through the rubber tap to form an ink flow path that communicates with ink nozzles of the recording head. To easily penetrate through the rubber tap, the ink supply needle is provided with ink supply holes on a side surface thereof. The supply holes have a diameter about 1 mm. The needle is constructed from a metal pipe formed of an anti-corrosion material such as stainless steel. Moreover, the tip of the pipe is extremely sharp to penetrate the rubber tap. Accordingly, the user must operate the sharpened needle very carefully or be subjected to potential injury.

To overcome the above problem, Unexamined Japanese Patent Application (OPI) No. Sho. 50-074341 proposes a solution. In this arrangement, a packing member is provided with a throughhole positioned at an end opening of an ink supply port. The throughhole of the packing member is sealed by a sealing member. Based thereon, the ink supply needle does not require an extremely sharp tip, since it is penetrating a seal member and not a rubber tap as in the prior art. However, in a conventional ink-jet recording apparatus using an ink tank which stores liquid ink directly therein, the apparatus suffers from several problems such as leakage of ink or a pressure difference which is due to an increase in pressure while penetrating the ink supply needle.

Furthermore, it is preferable to keep the ink supply pressure as a negative pressure from the ink tank to the recording head within a range from −30 to −100 mmAq (waterhead) to achieve a stable ink ejection of the recording head of the ink-jet type recording apparatus. However, due to the height level at which the ink tank is installed, it is difficult to control the ink supply pressure. This is particularly true when the ink-jet recording apparatus is configured with a carriage type system wherein a recording head and an ink tank cartridge are mounted on the carriage. Unexamined Japanese Patent Application (OPI) No. Hei. 2-187364 proposes that a porous member be housed within an ink tank (cartridge) to thereby generate a negative pressure between the ink tank and the recording head due to the capillary action of the porous member.

Japanese Patent Application Hei. 2-187364 is directed to one type of recording apparatus by which both an ink tank and a recording head are unitarily formed. When the ink contained in the ink tank is emptied, both of these components are replaced. Moreover, this application is silent with respect to the other problems or difficulties such as undesired air flow to the recording head or leakage of ink which may occur when the ink tank is selectively removed from the head.

Japanese Patent No. Hei. 3-61592 suggests 20 Torr as an appropriate negative pressure level for packing the ink tank cartridge. This negative pressure is much greater than the negative pressure under which the ink is filled within the tank. In fact, the negative pressure may cause a problem, because the ink tank cartridge may have atmospheric pressure previously applied thereto during the manufacturing process and because of the necessity of moving a filled cartridge some distance to the packaging station. Moreover, the timing for the ink-filling process and that for the packaging process are usually spaced far from each other. Therefore, air penetrating into the ink may be freed and produce air bubbles when a negative pressure applied during the packaging process is greater than that for the ink-filling process. As a result thereof, an undesirable ink-leakage may occur. Further, air bubbles generated in the porous member may obstruct the ink flowing from the ink tank cartridge to the recording head which could cause an ink-failure during the printing operation.

Accordingly, it is desirable to provide an ink tank cartridge in an ink-jet type recording apparatus which does not require a sharpened needle, is capable of preventing air (gas) from entering the ink supply path of the recording apparatus body even when the ink tank is replaced from the ink supply needle and has a high air tightness between the ink supply needle and the ink tank.

SUMMARY OF THE INVENTION

Generally speaking, in accordance with the invention, an ink tank cartridge for an ink-jet type recording apparatus being removably mounted onto an ink supply needle of a recording body is provided. The needle has at least one throughhole therein. The ink tank cartridge is provided with a housing having an inner chamber. An elongated ink supply port is provided which projects from and through the housing. The ink supply port has a first opening directed towards the interior of the chamber of the housing and a second opening essentially directed away from the exterior of the housing. At least one porous member is accommodated in the housing for carrying ink. The porous member is compressingly abutted against the first opening of the ink supply port. Packing means are provided in the ink supply port towards the second opening of the housing for resiliently abutting against an outer periphery of an ink supply needle of the recording apparatus. A sealing means is provided for substantially sealing the second opening of the ink supply port. The ink supply needle penetrates through the sealing means for mounting the ink tank cartridge to the recording apparatus.

This device is further provided with a filter essentially positioned at the first opening of the ink supply port so that the porous member compressingly abuts against the filter.

The porous member is compressed at a region in the vicinity of the first opening of the ink supply port so that the pores of the porous member are smaller in the region of the first opening than in other regions of the porous member within the chamber of the housing. Moreover, the porous member may be provided with two layers, a lower porous member positioned towards the first end of the housing and an upper porous member positioned towards the second end of the housing. In this construction, the pores of the lower porous member are smaller than the pores of the upper porous member. The device can further include a second porous member disposed within the ink supply port between the filter and the packing means with one of the electrodes of an ink end sensor being between the second porous member and the filter.

A stopping means is provided between the packing means and the sealing means for preventing pieces of the sealing means produced when the ink supply needle penetrates the sealing means from entering into the ink supply port. In this embodiment, the packing means includes at least one resilient ring and the sealing mean includes at least one resilient ring. In another embodiment, the packing means includes one elastic sealing member, while the sealing means includes one resilient ring. In still a further embodiment, the sealing means and the packing means are formed by a single unitary elastic sealing member having a groove. In yet still a further embodiment, the sealing means and the packing means are each formed with a resilient ring.

In another aspect of the invention, a method for storing and packing an ink tank cartridge for an ink jet type recording apparatus to form an air sealable container is provided. The steps of this method include wrapping the ink tank cartridge with a film. The free ends of the film are then fusedly bonded to form an air sealable container having a space therein. At the same time the container is decompressed so that the space is filled with a low pressured gas. The space in the container represents at least 15% of the total inside volume of the container. Moreover, the pressure in the container is maintained at a negative pressure which is slightly less than the pressure used when storing the ink in the ink tank cartridge. In an alternative embodiment, absorbing members can be inserted into the container for further maintaining the low pressure within the container.

Accordingly, it is an object of the invention to provide an improved ink tank cartridge for an ink jet recording apparatus.

It is another object of the invention to provide an ink tank cartridge and an ink-jet type recording apparatus which does not require a sharpened needle.

Yet still another object of the invention is to provide an ink tank cartridge which is capable of preventing air from entering the ink supply path of the recording apparatus body even when the ink tank is replaced from the ink supply needle.

Still another object of the invention is to provide an ink tank cartridge which has a high air tightness between the ink supply needle and the ink tank.

Yet another object of the invention is to provide an ink tank cartridge which maintains a constant negative pressure between the recording head and the ink tank cartridge due to a porous member positioned therebetween.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
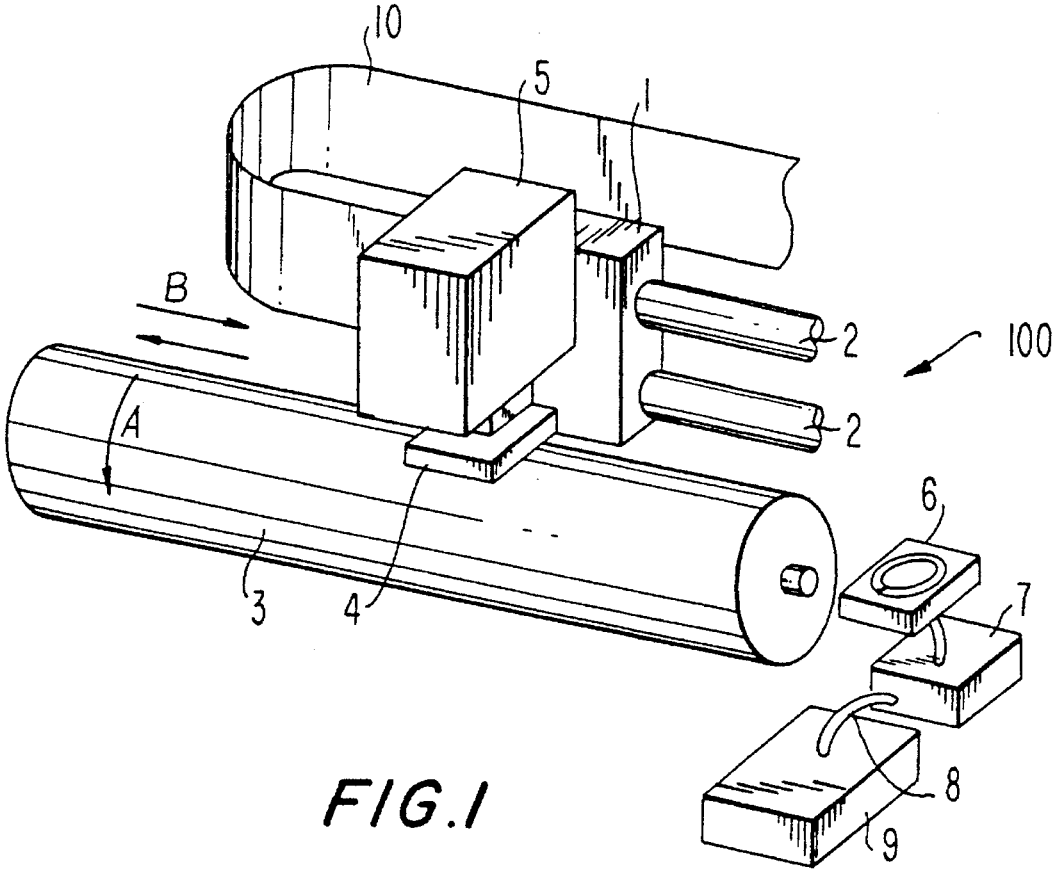
FIG. 1 is a perspective view of an ink-jet type recording apparatus with an ink tank cartridge attached thereto in accordance with the present invention.

Referring now to FIG. 1, an ink-jet type recording apparatus having an ink tank cartridge, generally indicated at 100, in accordance with the present invention is disclosed. Ink-jet type recording apparatus 100 is provided with a carriage 1 slidably mounted on guide shafts 2 with respect to a longitudinal axis of a platen 3 rotatable in the direction of Arrow A. Carriage 1 is reciprocally displaceable in the direction of arrows B. An ink-jet recording head 4 is provided for ejecting ink droplets towards platen 3 in accordance with a print signal. In addition, an ink tank cartridge 5 is provided for supplying ink to recording head 4. A capping apparatus 6 is disposed outside the printing region of the apparatus, but positioned so that it engages with a front surface of recording head 4. This engagement prevents the nozzle openings of recording head 4 from drying out, while the printing action is paused. The nozzle openings are sealed by capping member 6 and are forced to eject ink and air, if any, in the ink passages of recording head 4 by a negative pressure generated by a vacuum pump 7. The nozzle openings eject ink immediately after ink tank cartridge 5 is replaced with a new cartridge or when the nozzle openings' ink ejection ability is lowered during continuous printing operation. The ejected ink is drained toward an ink storage tank 9 through a pipe 8 and stored therein. Further, apparatus 100 is provided with a transmission cable 10 for transmitting printing signals to recording head 4.

Figure 2:
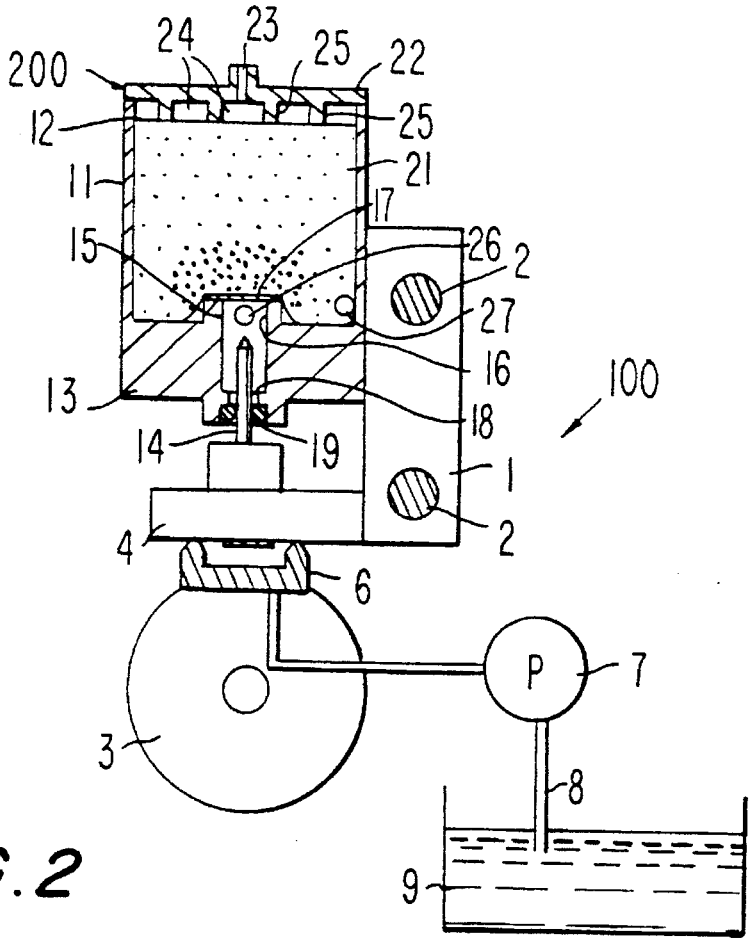
FIG. 2 is a sectional view of a first embodiment of the ink tank cartridge coupled the recording apparatus.

Referring now to FIG. 2, an embodiment of an ink tank cartridge 200 constructed in accordance with the present invention is shown. Ink tank cartridge 200 is applied to recording apparatus 100 as shown in FIG. 1. Ink tank cartridge 200 is provided with a housing 11 constituting an ink tank cartridge body. Housing 11 is unitarily formed with an opening 12 at a top surface and an ink supply port 15 integrally formed therewith at a bottom surface 13 thereof. Ink supply port 15 resiliently engages with a hollow ink supply needle 14 as more particularly described below. Housing 11 is tapered in such a manner that the bottom surface 13 is smaller in diameter than the top surface of the ink tank cartridge. In an alternative embodiment, housing 11 may be formed in a cylindrical shape having straight walls.

Ink supply port 15 is pipe-like shaped and projects inwardly and outwardly from the bottom wall of housing 11. More specifically, ink supply port 15 is mounted so that it partially extends into the chamber of housing 11 and partially extend away from bottom surface 13 of housing 11. A mesh filter 17 having a pore size of about 20 to 100 μm is fuse bonded onto an inner opening 16 of ink supply port 15 projecting towards the inner chamber of housing 11. In the preferred embodiment, filter 17 may be formed of a high polymer material or an anti-corrosion metal such as stainless steel. A step portion 18 is formed in the inner wall of ink supply port 15 at a point spaced a short distance from the outer opening of ink supply port 15. A packing member 19 is provided for resiliently contacting ink supply needle 14 and is disposed inside ink supply port 15 at a lower side of step portion 18. This arrangement maintains the liquid (i.e. ink) in a sealed condition within ink supply port 15.

Figure 3:
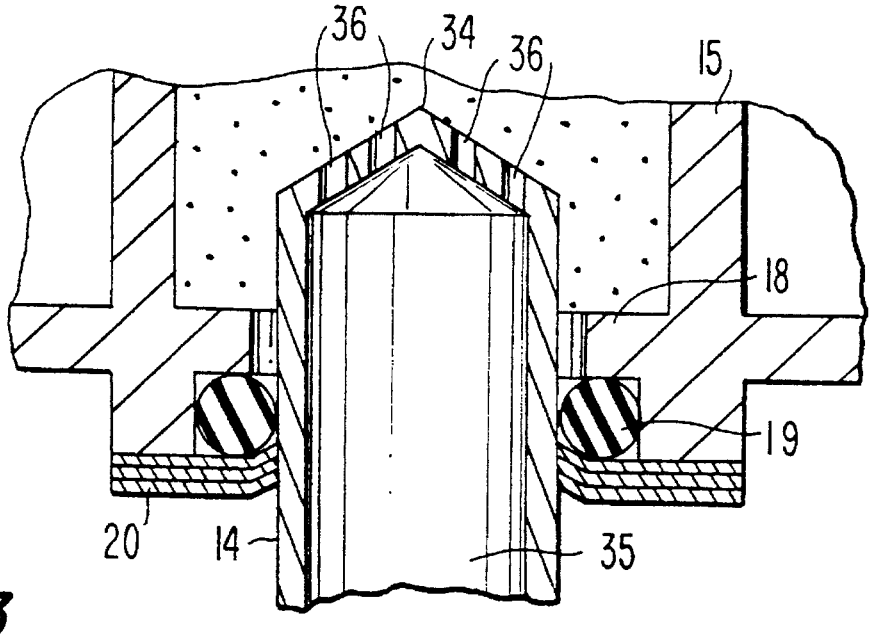
FIG. 3 is an enlarged sectional view of an ink supply needle penetrating the ink tank cartridge of FIG. 2.

In this embodiment, packing member 19 is formed of a rubber ring, and more specifically, an O-ring. A sealing film 20 as shown in FIG. 3 is fuse bonded onto the outer opening of ink supply port 15. In a preferred embodiment, film 20 is formed of a sealing material such as a high polymer film or a high polymer film with a metal layer laminated on the film. In this manner, film 20 demonstrates a high sealability so that it is not torn by an external force such as a contact by a finger of the user.

A porous member 21 is constructed with a width slightly wider than opening 12 of housing 11 and has a height slightly greater than housing 11. In a preferred embodiment, porous member 21 is formed from urethane foam. Porous member 21 is compressed in the chamber of housing 11. Further, the lower end portion of porous member 21 faces filter 17 of ink supply port 15. The central region of this lower end portion of the porous member is compressed against and by ink supply port 15 protruding inside the housing. A lid 22 covers opening 12 of housing 11 and includes a plurality of ribs 25 projecting towards the inner chamber of housing 11 so that lid 22 further compresses porous member 21 and holds it in the desired position. Moreover, spaces 24 are formed within ink tank cartridge 11 between lid 22 and porous member 21 to maintain a constant air pressure therein. Spaces 24 communicate to the outside air (atmospheric pressure) through air vent 23.

Because of the compression of porous member 21 by ink supply port 15, the pores of the compressed region of porous member 21 near ink supply port 15, and in particular facing the inner opening of the ink supply port, are smaller than the pore size of the remainder of porous member 21. Moreover, as shown in the embodiment disclosed in FIG. 12 as will be detailed below, the pore size of a second porous member positioned in ink supply port 15 between filter 17 and packing member 19 may be smaller than the ports of the compressed region of porous member 21.

Figure 4:
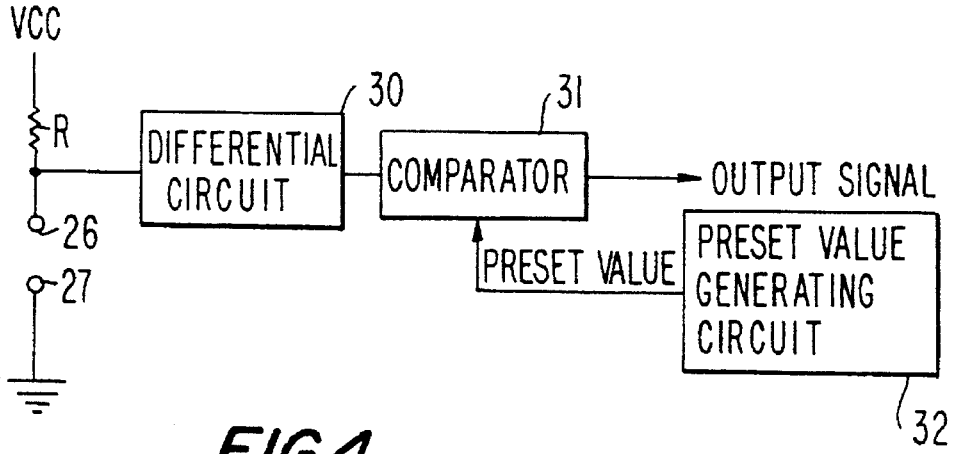
FIG. 4 is a circuit-block diagram of an ink end detection circuit.

A first electrode 26 is provided in ink supply port 15, while a second electrode 27 is provided in the chamber of the housing adjacent bottom surface 13 of housing 11 to form an ink end sensor to detect an ink end condition. This condition is present when the ink is almost empty in the tank so that ink is present essentially only ink supply port 15. As shown in FIG. 4, an AC voltage Vcc is applied to electrodes 26, 27 through a resistor R. A variation in voltage between electrodes 26, 27 is detected by a differential circuit 30. A comparator 31 compares an output signal of differential circuit 30 with a preset value generated by a preset value supplying circuit 32. The output signal of comparator 31 represents a voltage variation ratio of the two inputs to the comparator. If the voltage variation ratio is larger than a preset value, that is, the ink impregnated in the porous member 21 becomes almost empty, an ink end signal is output and the ink end condition is therefore detected.

Referring to FIG. 3, hollow ink supply needle 14 is formed with a conical end to cooperate with ink tank cartridge 200. A plurality of throughholes 36 are formed on a tip end surface 34 of ink supply needle 14 for communicating the ink contained within ink supply port 15 with an ink supply path 35 formed inside needle 14.

Ink was loaded into porous member 21 under low pressure of about 0.2–0.4 atmospheric pressure to fill essentially all of the pores of the porous member. Ink filled under low pressure is very useful as a means for maintaining good printing quality as taught in Unexamined Japanese Patent Application (OPI) No. Sho. 60-245560. In particular, such loading prevents the entrapment of air bubbles in the porous member and permits filling to the capacity thereof. After the ink is filled into porous member 21, ink tank cartridge 200 is packed for shipping in a bag formed of a highly sealable material. An example of this sealable material is a laminate film having aluminum layers. The laminate film may have an inner plastic layer to facilitate fusing.

Figure 5:
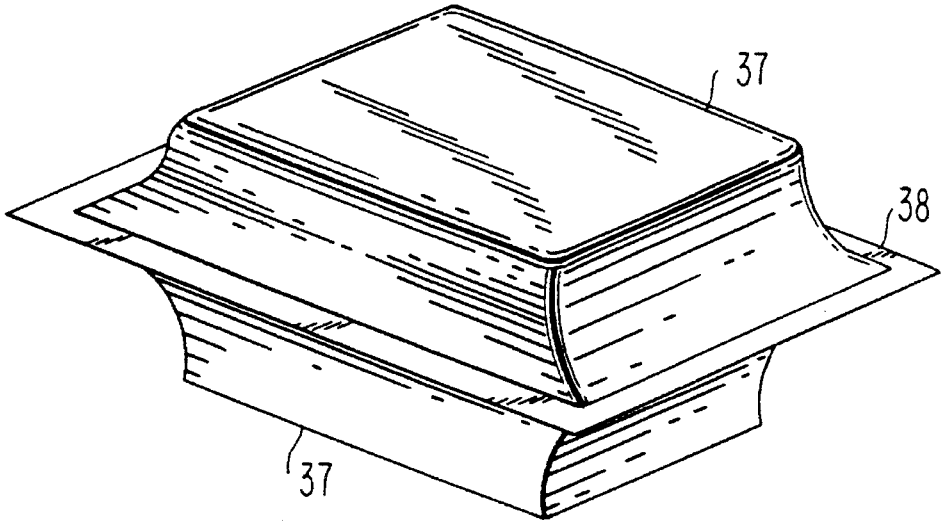
FIG. 5 is a perspective view of a container for storing the ink tank cartridge of FIG. 2.

FIG. 5 illustrates an example of a container for storing and packing ink tank cartridge 200 therein in accordance with the present invention. Ink tank cartridge 200 is wrapped by a pair of laminate films 37. Laminate film 37 is formed of a film including at least a layer of aluminum. More specifically, in a preferred embodiment, the film may be formed with a combination of polyethylene, glass and polyethylene teraphthalate. While decompressing (removing) air in the container, flange portions 38 of films 37 are fuse bonded to maintain the pressure in the container. The two step process forms a container with high sealibility. The container is formed so that there is a space between the container and the ink tank cartridge. In a preferred embodiment, the space maintained in the container represents at least 15% of the total inside volume of the container after packed. In fact, a space representing more than 15% of the total internal volume is preferred. It is preferable that the ink tank cartridge be packed under a negative pressure which is slightly greater (closer to atmospheric pressure) than the pressure under which the ink is filled within the tank. In a preferred embodiment, the pressue in the space is about atmospheric, rather than the pressure at the time of ink impregnation.

In order to effectively prevent the deterioration of the printing quality due to the free gas produced in inks having dyes, low pressure must be maintained within the packaged container. At the same time, the amount of gas to be impregnated in the ink is lowered. Inks with dyes give off a very small amount of gas over a period of time. Further, even in case of using an ink which is not subjected with deaeration, the presence of the low pressure space within the container aids the ink in its deaeration process while stocked. Moreover, the ink is prevented from leaking from the container to the outside.

The low pressure value discussed above with respect to the packaging process under low pressure and the deaeration rate of ink under the low pressure condition after a stocking period will be described with reference to the amount of nitrogen as a main part of air.

TABLE 1

| Low pressure value (atmospheric pressure) | Amount of Nitrogen (ppm) |
|---|---|
| 0.5 | 7.5–9.0 |
| 0.35 | 7.0–8.5 |
| 0. | 6.0–7.5 |

According to the invention, the deaeration rate of the ink contained within ink tank cartridge 200 can be controlled by varying the pressure during the packaging process. Table 1 above discloses the packaging pressure (negative gauge pressure), the nitrogen density during the packaging process being set at a saturation level of 13–14 ppm. The table also discloses the nitrogen density impregnating into the ink contained in the ink tank cartridge, when the packaging container is opened. At the same time, FIG. 6 discloses the deaeration variation of ink contained in the ink tank cartridge after opening the container with reference to an amount of nitrogen contained in the ink.

Figure 6:
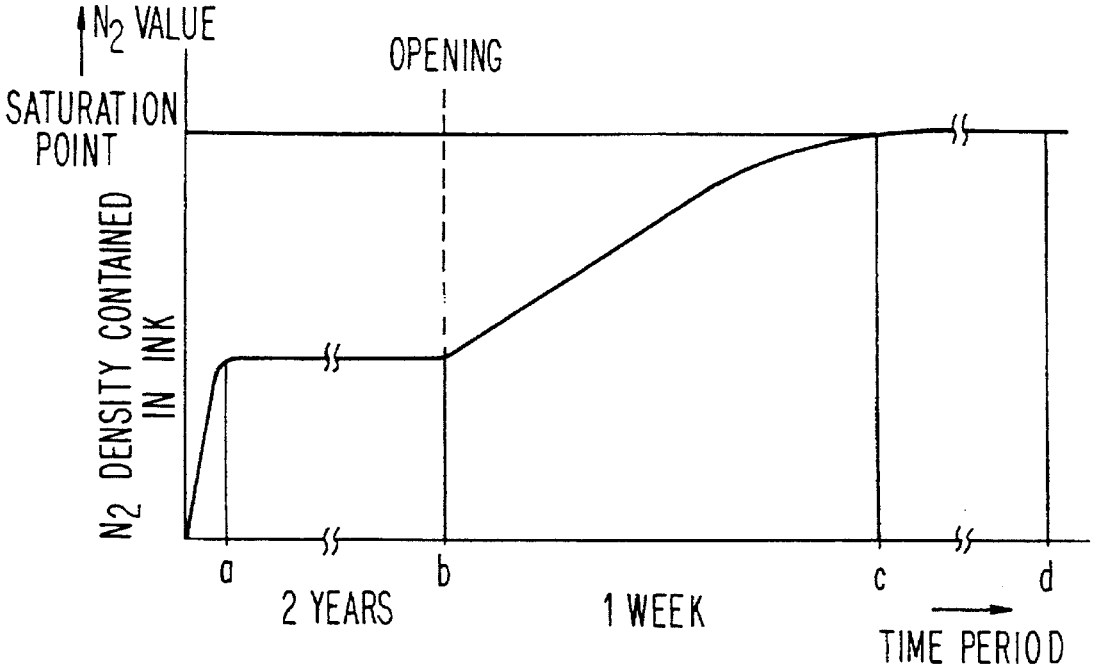
FIG. 6 is a graphical representation of the variation of the amount of nitrogen with respect to the ink during the life of the ink tank cartridge.

The arrangement of ribs 25 of lid 22 on the top of ink tank cartridge 200 form a space therein as set forth above. Therefore, a constant amount of air is stored in ink tank cartridge 200 corresponding to the pressure existing within the bag immediately after the packaging process. Accordingly, after a short period a, the density of nitrogen within the ink rapidly rises up as shown in FIG. 6. Thereafter, the density remains constant, because of the high sealability of the container. The constant level can be maintained for approximately two years from the manufacturing process. Once the container is opened at a point b, the amount of nitrogen contained in the ink increases and reaches a saturation point c approximately one week after opening. Even in the saturation condition, the printing quality does not deteriorate within period b to d, approximately one to four weeks later. In fact, once a cartridge is opened, a typical cartridge is used for printing for only a one to four week time period.

The deaeration effect of ink is set forth below. When ink tank cartridge 200 is removed from and attached to ink supply needle 14, the amount of air entering from the hollow needle is normally extremely small. More specifically, when a diameter of the hollow needle is about 0.8 mm, the air entering was less than 0.4 $mm^3$ which corresponds to an amount a meniscus of ink. Once the ink enters ink supply port 15 as shown in FIGS. 2 and 3, the ink flows towards recording head 4 and is trapped by a filter 17 (not shown) mounted in a filter chamber. The air trapped by filter 17 does not easily pass through filter 17, because the pore size of the filter is very fine. When employing a filter having a diameter of about 4 mm and a thickness (height of filter chamber) of approximately 0.3 to 0.5 mm and after removing and attaching the ink tank cartridge to the needle many times, air does not pass through the filter, while the recording apparatus is operated.

Accordingly, during the period from point b to c of FIG. 6, the deaerated ink is supplied to the recording head. If ink tank cartridge 200 is removed and attached to ink supply needle 14 and air enters ink supply port 15 from needle 14, the air is impregnated into the ink. However, the recording apparatus does not suffer from any problems caused by this introduction of air.

On the other hand, when ink tank cartridge 200 is removed from the apparatus and left uncovered for a period of time, air will then enter from the hole in film 20 formed by the ink supply needle. As is well-known in the art, air destroys the siphon phenomenon and causes an undesired ink-failure in recording head 4. To prevent this problem, the ink-jet type recording apparatus is provided with a vacuum pump 7 as shown in FIGS. 1 and 2 for forceably ejecting ink from the ink nozzles and by applying a negative pressure to recording head 4. In this operation, the ability to recover from ink-failure depends on the deaeration rate of the ink. In case of using ink one to four weeks after the container is opened, no problem occurs when the air contained in the filter chamber is ejected by the operation of vacuum pump 7. On the other hand, after that time period, if the amount of air contained in the ink is completely saturated or may even be excessively saturated due to a variation in temperature, fine air bubbles may be generated by an action of negative pressure during the ink-failure preventing operation. This action causes an obstruction of ink flow from the ink tank cartridge.

Figure 7:
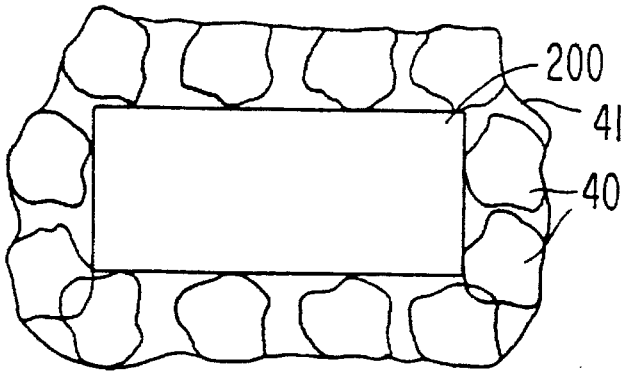
FIG. 7 is a sectional view of an alternative embodiment of the container of FIG. 5.

Referring now to FIG. 7, an arrangement for packaging ink tank cartridge 200 is disclosed in which cartridge 100 is surrounded by absorbing members such as sponge grains 40 and accommodated in a packaging bag 41. Bag 41 is subjected to a decompression process. According to this arrangement, since sponge grains 40 form a space inside packaging bag 41, the low pressure condition formed during the packing process can be continued for a long time period. If the ink is filled in porous member 21 of FIG. 2 to the greatest extent possible, for example, if approximately 95% of the volume of the porous member is represented by the ink accommodated in ink tank cartridge 200, the printing quality and efficiency of the ink-filling can be improved.

When ink tank cartridge 200 is packed in the manner described above, packaging bag 41 is opened and tank cartridge 200 is taken from bag 41. Ink tank cartridge 200 is then mounted on carriage 1 of FIG. 1 of recording apparatus 100 in such a manner that the outer opening of ink supply port 15 directed away from the bottom surface 13 is positioned just above ink supply needle 14. As shown in FIG. 3, ink tank cartridge 100 is then depressed in a direction parallel to the needle towards needle 14. Ink supply needle 14 penetrates sealing member 20 (i.e. film) and reaches packing member 19 (i.e. O-ring). In this condition, a tip end portion of ink supply needle 14 is maintained in a liquid sealing condition with respect to ink supply port 15 by packing member 19 (i.e. O-ring), while communicating with ink contained within ink supply port 15.

When ink supply needle 14 penetrates sealing member 20, sealing member 20 is deformed. In this manner, sealing member 20 conforms to the end contour of needle 14 until penetration, because of the resiliency of sealing member 20. Throughholes 36 formed at the tip end of ink supply needle 14 have a diameter in the range of about 0.1 to 0.4 mm. This range of sizes of throughholes 36 maintains a meniscus therein, when cartridge 200 is replaced or exchanged. Accordingly, air is prevented from entering ink tank cartridge 15 from ink supply needle 14, and therefore recording head 4. Further, since a plurality of throughholes 36 are provided, the fluid resistance applied to the ink flowing therethrough is very small. Accordingly, a sufficient amount of ink for the printing can be supplied to recording head 4.

Further, since porous member 21 is resiliently deformed and compressed by ink supply port 15 projecting inward in tank housing 11, the pore size of porous member 21 at a region in the vicinity of the ink supply port 15 is smaller than that of other regions therein so that the capillary force is large relative to the other regions. Based thereon, the ink is concentrated in the compressed portion of porous member 21, and further the ink can be supplied to recording head 4 until essentially the last droplet.

Figure 8:
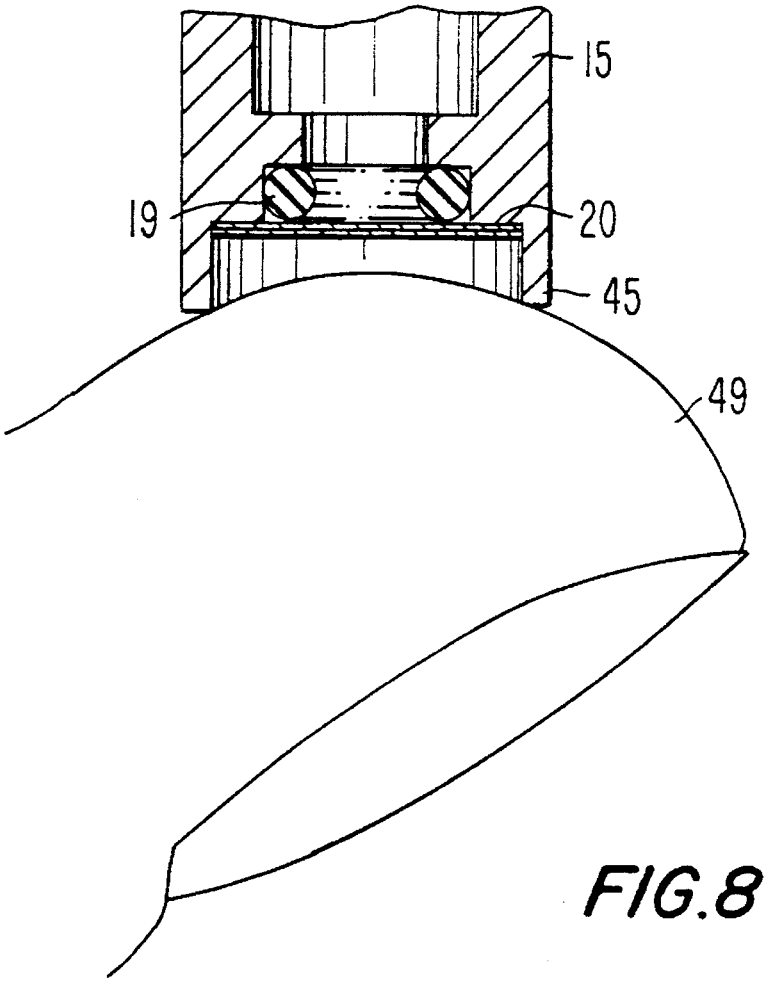
FIG. 8 is a sectional view of the ink tank cartridge of FIG. 2 having a flange.

In the above embodiment, sealing member 20 disposed at ink supply port 15 is exposed to a variety of elements when not connected. However, in a preferred embodiment, an axially extending flange 45 is formed surrounding sealing member 20 as shown in FIG. 8. Flange 45 provides protection from an unintentional touch of a finger 49 or other elements to sealing member 20. Flange 45 not only prevents sealing member 20 from being torn, but can also be used as a guide member for easily positioning ink supply needle 14 to the correct point for penetration.

Figure 9A:
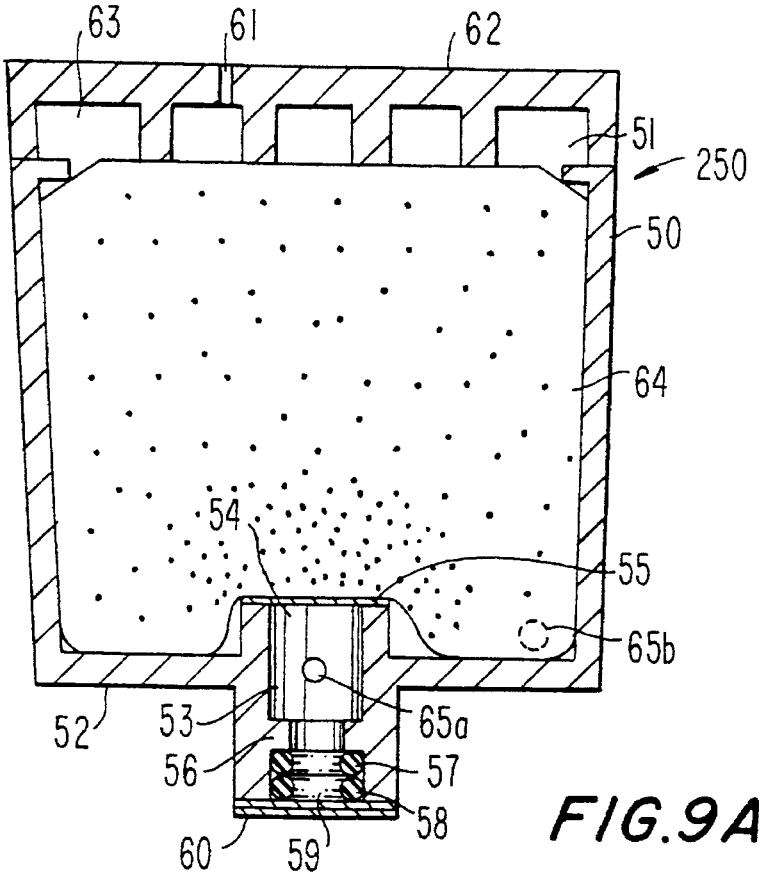
FIG. 9 is a sectional view an ink tank cartridge in accordance with an alternative embodiment of the invention.

Reference is now made to FIG. 9A which discloses an ink tank cartridge in accordance with another embodiment of the invention. An ink tank cartridge 250 of this embodiment is provided with a housing 50 forming the ink tank cartridge body. Housing 50 is provided with an opening 51 at a top surface thereof and a pipe-like ink supply port 53 projecting from a bottom surface 52. Ink supply port 53 receives ink supply needle 14 disposed on the recording apparatus side. Housing 50 is tapered so that the bottom surface diameter is smaller than that of the top surface diameter. Ink supply port 53 is provided with an opening 54 onto which a filter 55, formed of high polymer or anti-corrosion metal, is fuse bonded thereon. A step portion 56 is formed in an inner wall of ink supply port 53 spaced from the outer end of port 53. A packing member 57 is fitted at the outer side (closer to the outer opening) of step portion 56 for maintaining liquid sealability by resiliently abutting against ink supply needle 14. In this embodiment, packing member 57 is an O-ring.

Further, a sealing stopping member 58 (i.e. film) is fitted below packing member 57. Sealing stopping member 58 is also an O-ring. An outer opening 59 is sealed by a sealing member 60 having a high air-sealability characteristics. For example, sealing member 60 is a laminated film through which ink supply needle 14 can easily penetrate. Opening 51 of housing 50 is sealed by a lid 62 having a vent hole 61. Hole 61 is provided for communication with the atmosphere. An inner surface of lid 62 is provided with a plurality of ribs 68 for defining spaces 63 between porous member 64 and lid 62 which communicate with vent hole 61 to maintain a constant air pressure within housing 50. Ink tank cartridge 250 is further provided with electrodes 65*a* and 65*b* for detecting an ink end condition.

Figure 9B:
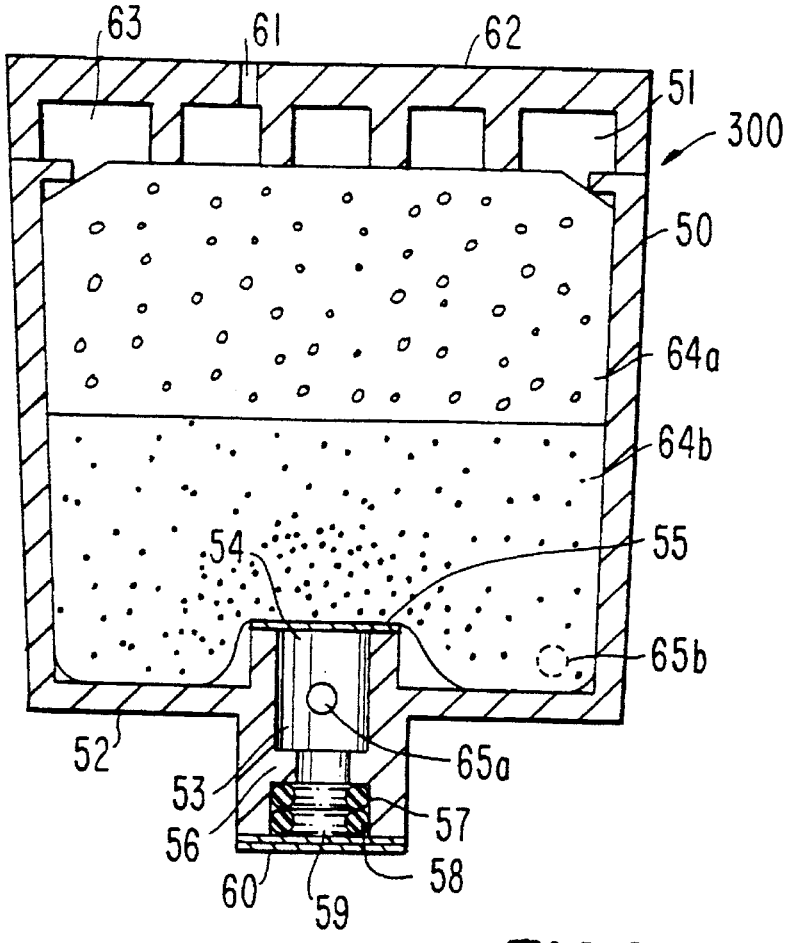

Referring now to FIG. 9B (like reference numerals being applied to like elements), an ink tank cartridge 300 is provided in accordance with another alternate embodiment of the invention. The porous member of FIG. 9A is formed in ink tank housing 50 of FIG. 9B with two separate porous members, an upper porous member 64*a* and a lower porous member 64*b*. Upper porous member 64*a* is larger in pore size than lower porous member 64*b* so that the capillary force is larger at the lower side, closer to ink supply port 53. The remaining elements of ink tank cartridge 300 are the same as the elements disclosed in ink tank cartridge 250 of FIG. 9A. Moreover, although the arrangement disclosed with respect to FIG. 9B has a porous member divided into two distinct layers, the porous member may be divided into more than two layers as long as each layer closer to the port has smaller pores than the layer further away.

With ink tank cartridges 250 and 300 described above, deaerated ink is filled within porous member 64 or 64*a* and 64*b* accommodated in tank housing 50 under low pressure. The ink tank cartridges are then packed in a package bag, similar to package bag 41 of FIG. 7, for stocking while maintaining a negative pressure slightly higher (i.e., closer to the atmosphere's pressure) than that during the ink-filling process. When ink tank cartridge 250 or 300 is exchanged with a new one, packaging bag 41 is opened to remove the new ink tank cartridge from the bag. The tank cartridge is then mounted on a carriage 1 of recording apparatus 100 in such a manner that a tip end opening of ink supply port 53 is positioned just above ink supply needle 14 and then depressed in the parallel direction parallel to the needle 14 towards needle 14.

In this operation, ink supply needle 14 penetrates sealing member 60 and reaches packing member 57 through sealing stopping member 58. After insertion, ink supply needle 14 is maintained in a liquid-tight condition with respect to ink supply port 53 by packing member 57. At the same time, ink supply needle 14 communicates with ink contained within ink supply port 53.

Figure 10A:
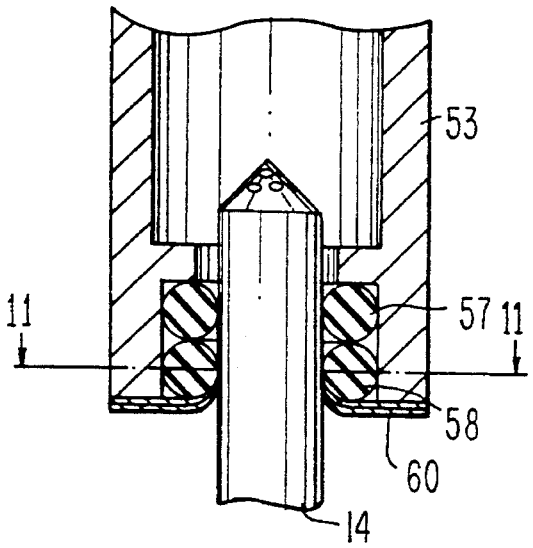
FIG. 10A is an enlarged sectional view of a sealing member and a sealing stopping member of FIG. 9.
Figure 11:
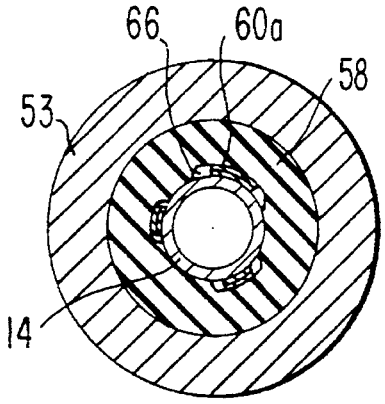
FIG. 11 is a sectional view taken along the line 11—11 of FIG. 10A.

When ink supply needle 14 penetrates sealing member 60, portions of sealing member 60 are broken off by the force of ink supply needle 14 entering ink supply port 53, as shown in FIG. 11, to form broken pieces 60*a*. However, based on the construction of the ink tank cartridge, broken pieces 60*a* of sealing member 60 are prevented from entering into ink supply port 53. This stoppage is caused by sealing stopping member 58 which forms an essentially tight grip with ink supply needle 14 as shown in FIGS. 10A and 11. Therefore, broken pieces 60*a* do not reach packing member 57. Accordingly, even if gaps 66 are formed between needle 14 and sealing stopping member 58, the liquid sealability can be maintained by packing member 57. Furthermore, the ink is prevented from leaking out of ink supply port 53.

Figure 10B:
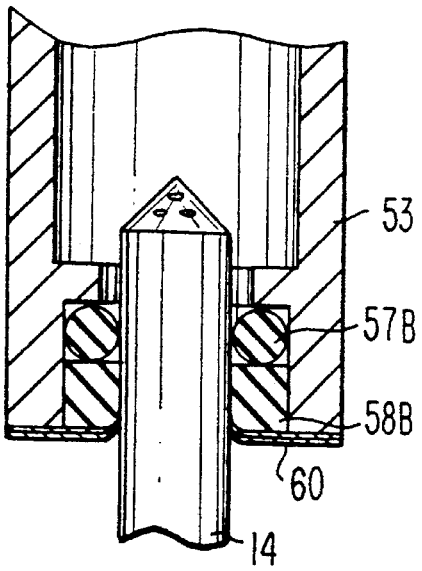
FIGS. 10B–10E are enlarged sectional views of alternative embodiments of the construction of FIG. 10A.
Figure 10C:
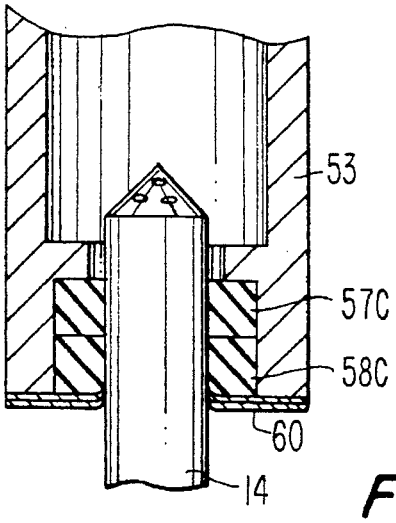
Figure 10D:
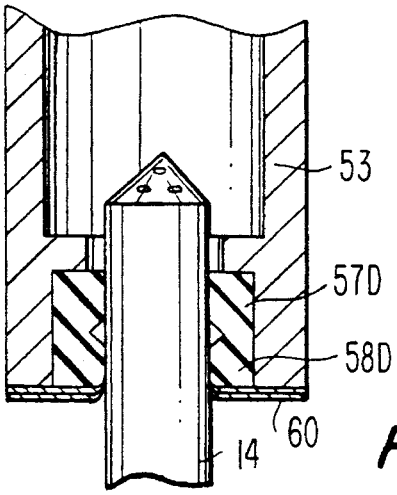
Figure 10E:
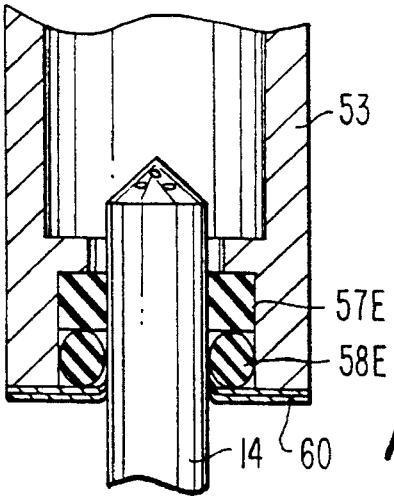

Reference is now made to FIGS. 10B–10E which disclose additional embodiments of ink tank cartridges 250 and 300 with respect to sealing member 57 and sealing stopping member 58. In all other respects, the ink tank cartridges are the same and like reference numerals are used for like elements. Although each sealing member and sealing stopping member of FIGS. 10B–10E are shaped and designed differently, the sealing member 57 and sealing stopping member 58 of FIG. 10A, each basically functions and operates in the same manner. In the arrangement disclosed in FIG. 10B, sealing stopping member 58B is an elastic sealing member, while sealing member 57B is an O-ring. In FIG. 10C, both sealing member 57C and sealing stopping member 58C are elastic sealing members. Referring to FIG. 10D, sealing member 57D and stopping sealing member 58D form a unitary block which is provided with a groove therebetween. Finally, in the configuration of FIG. 10E, sealing member 57E is an elastic sealing member, while sealing stopping member 58E is an O-ring.

Figure 12:
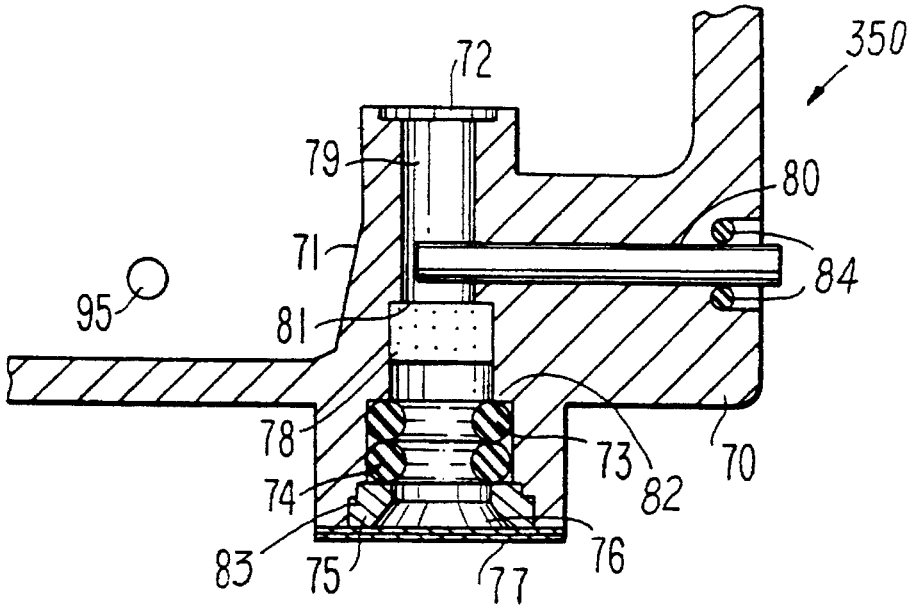
FIG. 12 is a fragmentary, enlarged sectional view of an ink tank cartridge in accordance with an alternative embodiment of the present invention.

Reference is now made to FIG. 12 which discloses an ink tank cartridge 350 in accordance with still another embodiment of the present invention. In this configuration, a pipe-like ink supply port 71 is formed on a bottom wall 70 of housing 90 for accommodating a porous member (not shown, but similar to porous member 21 of FIG. 2) for filling ink therein. A filter 72 is fixed to an inner opening 79 of ink supply port 71. The porous member impregnated with ink resiliently abuts against ink supply port 71 to be compressed thereby. The interior of ink supply port 71 is formed with several integral regions of increasing diameter from the region of inner opening 79. A packing member 73 and a seal stopping member 74 are press fitted in an inner portion of ink supply port 71 against step 82 and secured by a bushing 75 engaging steps 83. A lower opening 76 is sealed by a sealing member 77 (i.e. film).

An electrode 80 is disposed within ink supply port 71 in the vicinity of inner opening 79 for detecting an ink end condition. Ink tank cartridge 350 is further provided with a porous member 78 fitted against step 81 in ink supply port 71 between electrode 80 and packing member 73. In a preferred embodiment, porous member 78 is formed of a urethane foam. An upper portion of porous member 78 engages with step portion 81 formed inside ink supply port 71 to prevent porous member 81 from moving even when ink supply needle penetrates into ink supply port 71. Porous member 81 is preferably press fitted into position. A second electrode 95 is also provided for detecting the ink end condition in conjunction with first electrode 80. O-ring 84 provides a seal around the outer end of electrode 80, where it passed through bottom wall 70.

The purpose of porous member 78 is to avoid a false ink end condition by preventing air flow back to electrodes 80 of the ink end sensor when the ink tank cartridge is removed from the needle, but the ink is not yet exhausted. When porous member 81 is in position, ink from the main porous member (not shown) remains in the portion of the tubular passage in ink supply port 71 between inner end 79 and porous member 78 so that a false ink end condition is avoided. The ink stays in this location, because of a balance of pressure and meniscus forces. Normal atmospheric pressure is applied to both the top end of the main porous member within the chamber and the bottom end of porous member 81 now exposed to the atmosphere, because of the piercing of sealing member 77. Thus, the pressures are in balance. A balanced equilibrium is also developed between the meniscus force in the two porous members, thereby preventing air flow back to electrode 80 of the ink end sensor. The pore size of the main porous member may be selected to be less than the pore size of porous member 81, even when compressed.

Figure 13:
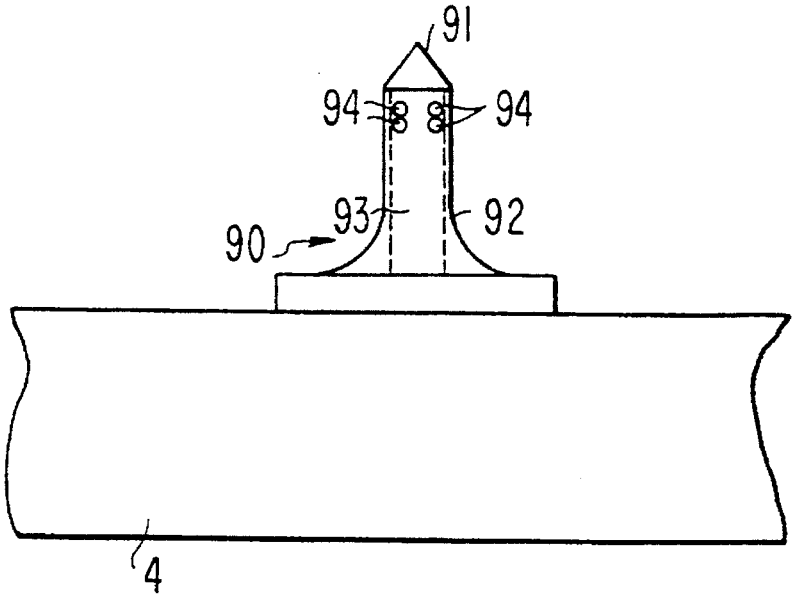
FIG. 13 is a front elevational view of an ink supply needle to be applied to the ink tank cartridge of FIG. 12.

An ink supply needle 90, as shown in FIG. 13, is applied to ink tank cartridge 350 of FIG. 12. Ink supply needle 90 is provided with a tip end 91 having a conical shape and an inclined surface for easily penetrating sealing member 77, sealing stopping member 74 and packing member 73 of ink tank cartridge 350 of FIG. 12. Needle body 92 has essentially parallel openings 94 in the side wall thereof communicating with an ink supply path 93.

Figure 14A:
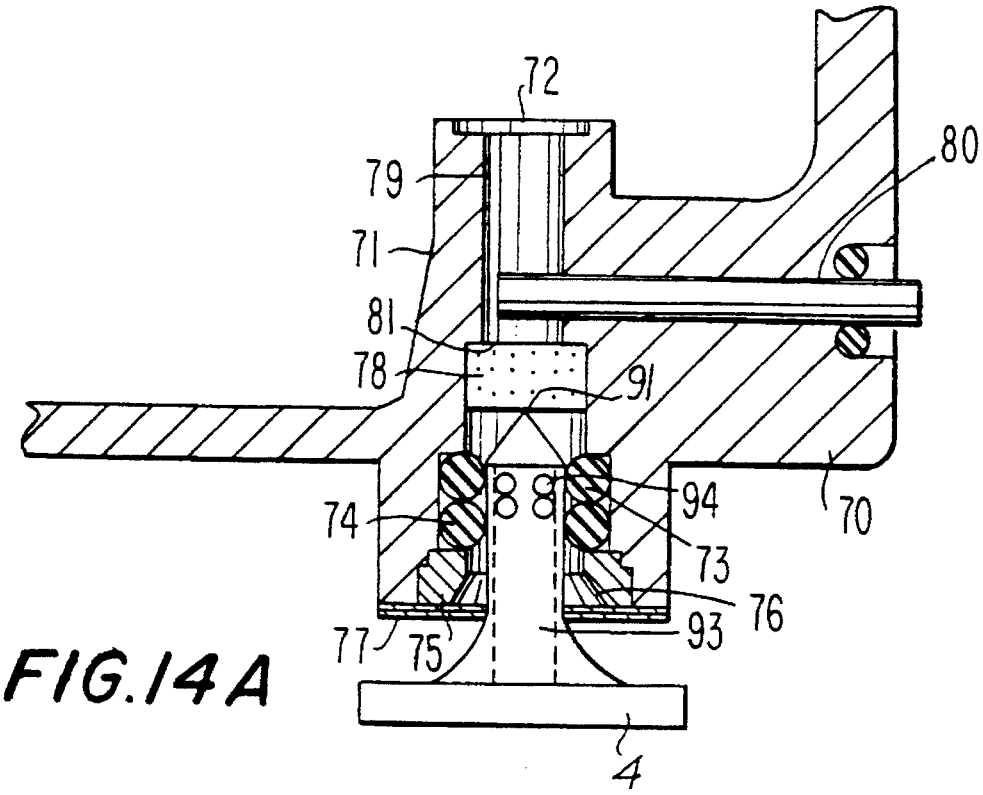
FIGS. 14A–B are sectional views of the penetration of the needle of FIG. 13 into the ink tank cartridge of FIG. 12.

To mount ink tank cartridge 350 with needle 90, sealing member 77 is positioned over ink supply needle 90. Ink tank cartridge 350 is then pushed downward onto tip 91 of needle 90 so that ink supply needle 90 penetrates sealing member 77 and passes through sealing stopping member 74 and packing member 73. Since ink supply needle 90 is not provided with holes at tip end portion 91 thereof, the variation in volume of ink in the interior of ink supply port 71, typically caused by a piston-effect during the mounting operation of the ink tank cartridge, is received by tip end portion 91 and packing member 73 as shown in FIG. 14A. However, packing member 73 essentially blocks the introduction of ink into openings 94 of ink supply needle 90. Therefore, the variation in volume of ink occurs in the upper side of ink supply port 71 through porous member 78, and not in ink supply path 93. Thus, when openings 94 pass through packing member 73 during the mounting process ink then flows into ink supply path 93 through openings 94 as shown in FIG. 14B.

As set forth above, during the mounting operation of ink tank cartridge 350, the undesirable variation in volume due to the piston effect applied to recording head 4 can be prevented. In particular, since ink supply path 93 does not immediately communicate with ink supply port 71, the leakage of ink from the nozzle opening of the recording head is effectively avoided. Further, it is not necessary to form the throughholes in the tip portion of needle 90, since ink supply needle has sufficient mechanical strength. Accordingly, needle 90 can be formed of a material other than metal such as, for example, a high polymer material. The ink supply needle formed of a high polymer material is advantageous in that the manufacturing process can be simplified. Moreover, the danger typically associated with a metal needle can be avoided.

Furthermore, the inner diameter of through holes 94 can freely be selected to the extent that the construction maintains a meniscus. The outer diameter of the ink supply needle can also be designed large as long as it controls an appropriate flow resistance of the ink through the needle. If needle 90 is formed of the high polymer material, the ink supply needle can maintain a mechanical strength sufficient for penetrating into ink tank cartridge 350.

Figure 14B:
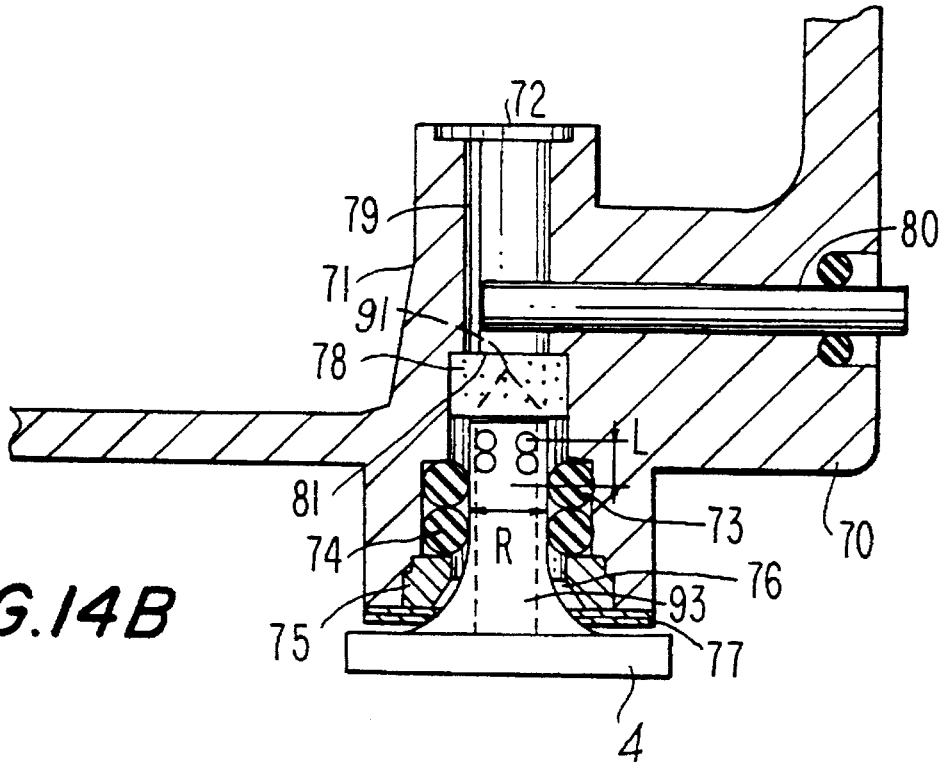

In a preferred embodiment, ink supply needle 90 shown in FIG. 14B is designed to meet specific parameters. For example, an outer diameter R of needle 90 is within a range of approximately 2–4 mm. Moreover, a length L between the center of the throughholes 94 closest to top end 90 of the needle and the center of packing member 73 when the ink tank cartridge is mounted onto the needles, also as shown in FIG. 14B, is set to a value less than about 2.5 mm. This arrangement is more preferable because the variation in volume when the ink tank cartridge is mounted on the ink supply needle is small and the undesirable piston effect can be minimized.

On the other hand, when ink tank cartridge 350 must be removed from ink supply needle 90 even though the ink is still filled within the tank (i.e. maintenance), ink existing around tip end 91 of ink supply needle 90 is sucked up toward porous member 78, since tip end 91 compresses porous member 78 when fully inserted, as shown in FIG. 14B. In this operation, since porous member 78 has a capillary force which is substantially the same as that of the porous member filled in the tank cartridge, and because of the balance of pressure and meniscus forces the ink remains in the interior of ink supply port 71 between porous member 78 and filter 72. Accordingly, the air is prevented from entering tank cartridge body 90. Further, if ink tank cartridge 350 is removed and remounted, electrodes 80 and 95 do not output a false signal indicating an ink end condition. As a result, the printing operation can be restarted merely by remounting ink tank cartridge 350 onto ink supply needle 90.

Needle 90 discloses parallel throughholes 94. However, other throughholes may be formed at an end surface thereof as shown in FIG. 3 as long as the piston effect during the mounting of the cartridge is small. Further, ink tank cartridge 350 utilizes bushing 75 to prevent packing member 73 and sealing stopping member 74 from falling out from ink supply port 71. However, bushing 75 may be omitted if the mechanical strength of sealing member 77 is relatively large.

As described above, according to the present invention, the ink tank cartridge is provided having removable housing with respect to the ink supply needle. The housing is provided with the ink supply port projecting from a bottom surface thereof both inwardly and outwardly. A porous member is provided for impregnating ink which is resiliently accommodated in the housing and is compressed against a filter secured to an end portion of the ink supply port. A packing member is disposed at the outer opening of the ink supply port for resiliently abutting against the periphery of the ink supply needle. A sealing member is provided for sealing the end opening of the ink supply port through which the ink supply needle penetrates. A second porous member is positioned in the ink supply port between the filter and the packing member. Accordingly, the ink tank cartridge of the invention is advantageous in that the ink supply needle does not require a sharpened tip end, air is prevented from entering the ink supply path of the recording apparatus, and high air-sealability between the ink supply needle and the ink tank can be maintained.

Moreover, the ink supply needle communicates with ink contained inside the tank which is tightly sealed by the packing member at the outer periphery of the needle so that the ink is supplied to the recording head, while keeping a constant negative pressure between the recording head and the tank due the porous member.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An ink tank cartridge for an ink-jet type recording apparatus being removably mountable onto an ink supply needle of said ink jet type recording apparatus, said ink supply needle having at least one throughhole to allow ink from said ink tank cartridge to pass therethrough, the ink tank cartridge comprising:

a housing formed with a chamber therein;

an ink supply port extending through and projecting from a wall of said housing, said ink supply port having a first opening directed towards said chamber of said housing and a second opening directed away from said wall of said housing;

a packing member provided within said ink supply port towards said second opening, said packing member being formed with a hole therethrough dimensioned to receive said ink supply needle and to resiliently abut against an outer periphery of said ink supply needle of the ink jet type recording apparatus, said packing member being for preventing the flow of ink through said ink supply port other than through said ink supply needle when said needle is positioned in said ink supply port; and a sealing member separate from said packing member positioned to seal said second opening of said ink supply port before said ink tank cartridge is mounted on said ink supply needle and to be penetrated by said ink supply needle when said ink tank cartridge is mounted on said ink supply needle.

2. The ink tank cartridge of claim 1, further including a filter essentially positioned at the first opening of said ink supply port.

3. The ink tank cartridge of claim 2, wherein the ink supply port substantially extends both inwardly and outwardly from said wall of said housing so that said ink supply port partially extends into said chamber and away from said wall of said housing.

4. The ink tank cartridge of claim 2, wherein said filter includes a mesh filter.

5. The ink tank cartridge of claim 4, wherein said mesh filter has a pore size of about 20 to 100 μm.

6. The ink tank cartridge of claim 4, wherein said mesh filter is formed of a stainless steel.

7. The ink tank cartridge of claim 2, wherein said filter is fuse bonded onto said first opening of said ink supply port.

8. The ink tank cartridge of claim 2, wherein said filter has a diameter of 4 mm and a thickness of about 0.3 to 0.5 mm.

9. The ink tank cartridge of claim 2, wherein said filter is formed of a high polymer material.

10. The ink tank cartridge of claim 2, wherein said filter is formed of an anti-corrosion metal.

11. The ink tank cartridge of claim 10, wherein said filter is formed of a stainless steel.

12. The ink tank cartridge of claim 2, wherein said filter has a plurality of pores, each having a pore size of about 20 to 100 μm.

13. The ink tank cartridge of claim 1, wherein said packing member includes at least one resilient ring.

14. The ink tank cartridge of claim 1, wherein said packing member includes at least one elastic sealing member.

15. The ink tank cartridge of claim 1, wherein said hole of said packing member is defined by an interior wall, said packing member including at least one elastic sealing member having a central interior groove in said interior wall for facing the ink supply needle.

16. The ink tank cartridge of claim 1, further including an ink end sensor positioned in said ink supply port.

17. The ink tank cartridge of claim 1, wherein said sealing member is formed of a high polymer film with at least one metal layer laminated on said high polymer film.

18. The ink tank cartridge of claim 1, wherein said sealing member is surrounded by a wall projecting from said second opening of said ink supply port.

19. The ink tank cartridge of claim 1, wherein said ink supply port is formed with a passage therethough between said first and second openings defined by a stepped wall, said stepped wall facing said second opening for positioning said packing member.

20. The ink tank cartridge of claim 1, wherein said sealing member includes a metal layer.

21. The ink tank cartridge of claim 1, wherein said ink supply port has a flange projecting from a lower end thereof.

22. The ink tank cartridge of claim 1, further including a porous member disposed within said ink supply port between said first opening of said ink supply port and said packing member.

23. The ink tank cartridge of claim 22, further including a step portion formed inside said ink supply port for engagement by said porous member to limit its position relative to said first opening.

24. The ink tank cartridge of claim 22, including an ink end sensor disposed between said first opening of said ink supply port and said porous member.

25. An ink tank cartridge for an ink-jet type recording apparatus being removably mountable onto an ink supply needle of a recording apparatus body, said ink supply needle having at least one throughhole to allow ink to pass therethrough, the ink tank cartridge comprising:

a housing formed with a chamber therein;

an ink supply port extending through and projecting from a wall of said housing, said ink supply port having a first opening directed towards said chamber of said housing and a second opening directed away from said wall of said housing;

a packing member provided within said ink supply port towards said second opening, said packing member being formed with a hole therethrough dimensioned to receive said ink supply needle and to resiliently abut against an outer periphery of said ink supply needle of the ink jet type recording apparatus, said packing member preventing the flow of ink through said ink supply port other than through said ink supply needle when said needle is positioned in said ink supply port;

a sealing member separate from said packing member positioned to seal said second opening of said ink supply port before said ink tank cartridge is mounted on said ink supply needle and to be penetrated by said needle when said ink tank cartridge is mounted on said ink supply needle; and a stopping member provided between said packing member and said sealing member positioned and dimensioned to prevent pieces of said sealing member produced when said ink supply needle penetrates said sealing member from entering said ink supply port past said sealing member.

26. The ink tank cartridge of claim 25, wherein said packing member includes at least one resilient ring and said stopping member includes at least one resilient ring.

27. The ink tank cartridge of claim 25, wherein said packing member includes at least one elastic sealing member and said stopping member includes at least one resilient ring.

28. The ink tank cartridge of claim 25, wherein said stopping member and said packing member are formed by a single unitary elastic sealing member being formed with an interior wall defining a hole therethrough for receiving said ink supply needle and to resiliently abut against said outer periphery of said ink supply needle.

29. The ink tank cartridge of claim 28, wherein said interior wall of said single unitary elastic sealing member includes a circumferential groove formed therein and positioned to face the ink supply needle when said ink supply needle is inserted in said hole.

30. The ink tank cartridge of claim 25, wherein said stopping member and said packing member are each formed by a resilient ring.

31. The ink tank cartridge of claim 25, wherein said ink supply port is formed with a passage therethrough between said first and second openings defined by a stepped wall, said stepped wall facing said second opening for positioning said stopping member and said packing member.

32. The ink tank cartridge of claim 25, further including a filter essentially positioned at the first opening of said ink supply port.

33. The ink tank cartridge of claim 32, wherein the ink supply port extends both inwardly and outwardly from said wall of said housing so that said ink supply port partially extends into said chamber.

34. The ink tank cartridge of claim 25, further including an ink end sensor positioned in said ink supply port.

35. The ink tank cartridge of claim 25, wherein said sealing member is formed of a high polymer film with at least one metal layer laminated on said high polymer film.

36. The ink tank cartridge of claim 25, wherein said sealing member is surrounded by a wall projecting from said second opening of said ink supply port for protecting said sealing member and serving as a guide for needle penetration.

37. The ink tank cartridge of claim 25, wherein said sealing member includes a metal layer.

38. The ink tank cartridge of claim 25, wherein said ink supply port has a flange projecting from a lower end thereof.

39. The ink tank cartridge of claim 25, further including a porous member disposed within said ink supply port between said first opening of said ink supply port and said packing member.

40. The ink tank cartridge of claim 39, further including a step portion formed inside said ink supply port for engagement by said porous member to limit its position relative to said first opening.

41. The ink tank cartridge of claim 39, further including an ink end sensor disposed between said first opening of said ink supply port and said porous member.

42. An ink-jet type recording apparatus for outputting ink onto a recording medium, comprising:

a recording head for ejecting ink;

an ink supply needle coupled to said recording head and having at least one throughhole; and an ink tank cartridge configured for storing ink and for receiving the ink supply needle so that ink can flow from said ink tank cartridge to said recording head through said throughhole in said ink supply needle, said ink tank cartridge having a housing formed with a chamber therein;

an ink supply port extending through and projecting from a wall of said housing, said ink supply port having first opening directed towards said chamber of said housing and a second opening directed away from said wall of said housing;

a packing member provided in said ink supply port towards said second opening, said packing member being formed with a hole therethrough dimensioned to receive said ink supply needle and to resiliently abut against an outer periphery of said ink supply needle of the subject type recording apparatus, said packing member being for preventing the flow of ink through said ink supply port other than through said ink supply needle when said needle is positioned in said ink supply port; and a sealing member separate from said packing member positioned to seal said second opening of said ink supply before said ink tank cartridge is mounted on said ink supply needle and to be penetrated by said ink supply needle when said ink tank cartridge is mounted on said ink supply needle.

43. The ink-jet recording apparatus of claim 42, further including a filter essentially positioned at the first opening of said ink supply port.

44. The ink-jet recording apparatus of claim 43, wherein said filter includes a mesh filter.

45. The ink-jet recording apparatus of claim 44, wherein said mesh filter has a pore size of about 20 to 100 μm.

46. The ink-jet recording apparatus of claim 44, wherein said mesh filter is formed of a high polymer material.

47. The ink-jet recording apparatus of claim 44, wherein said mesh filter is formed of an anti-corrosion metal.

48. The ink-jet recording apparatus of claim 47, wherein said mesh filter is formed of a stainless steel.

49. The ink-jet recording apparatus of claim 43, wherein said filter is fuse bonded onto said first opening of said ink supply port.

50. The ink tank cartridge of claim 43, wherein said filter is formed of an anti-corrosion metal.

51. The ink tank cartridge of claim 50, wherein said filter is formed of a stainless steel.

52. The ink-jet recording apparatus of claim 42, wherein the ink supply port extends both inwardly into said chamber and outwardly from said wall of said housing.

53. The ink-jet recording apparatus of claim 42, wherein said packing member includes at least one resilient ring.

54. The ink-jet recording apparatus of claim 42, wherein said packing member includes at least one elastic sealing member.

55. The ink-jet recording apparatus of claim 42, further including an ink end sensor positioned in said ink supply port.

56. The ink-jet recording apparatus of claim 42, wherein said filter has a diameter of about 4 mm and a thickness of about 0.3 to 0.5 mm.

57. The ink-jet recording apparatus of claim 42, wherein said sealing member is formed of a high polymer film with at least one metal layer laminated on said high polymer film.

58. The ink-jet recording apparatus of claim 42, wherein said sealing member is surrounded by a wall projecting from said second opening of said ink supply port for protecting said sealing member and serving as a guide for said needle.

59. The ink-jet recording apparatus of claim 42, wherein said ink supply needle is formed with a wall at least in part defining said throughhole of said ink supply needle, said wall of said ink supply needle including a plurality of holes therethrough configured to permit ink to flow into the throughhole of said ink supply needle.

60. The ink-jet recording apparatus of claim 59, wherein said wall of said ink supply needle is a peripheral wall, said holes being formed in said peripheral wall of said ink supply needle in a direction perpendicular to the direction in which said ink supply needle penetrates the hole in said sealing member.

61. The ink-jet recording apparatus of claim 42, wherein said ink supply needle is formed with a wall at least in part defining said throughhole of said ink supply needle, said wall of said ink supply needle including a plurality of throughholes at a side surface thereof configured to permit ink to flow into said throughhole of the ink supply needle.

62. The ink-jet recording apparatus of claim 42, wherein said holes in said peripheral wall of said ink supply needle are dimensioned to form an ink meniscus when an ink cartridge is removed therefrom.

63. The ink-jet recording apparatus of claim 42, wherein said ink tank cartridge and ink supply needle are dimensioned so that when said ink tank cartridge is mounted onto said ink supply needle a distance between where said ink supply needle makes contact with said packing member and the center of one of said holes extending through said peripheral wall closest to the end of said ink supply needle closest to said chamber of said ink tank cartridge is less than about 2.5 mm.

64. The ink-jet recording apparatus of claim 42, wherein an outer diameter of said ink supply needle is within a range of about 2–4 mm.

65. The ink-jet recording apparatus of claim 42, wherein said ink supply needle is formed of a high polymer material.

66. The ink-jet recording apparatus of claim 42, wherein said ink supply needle is formed of an anti-corrosion metal.

67. The ink-jet recording apparatus of claim 42, wherein said ink supply needle is formed of stainless steel.

68. The ink-jet recording apparatus of claim 42, wherein said ink supply needle includes a tip end closest to said chamber of said ink tank cartridge, said ink supply needle further including a wall at least in part defining said throughholes and said tip end of said ink supply needle, said wall being formed with a plurality of holes at the tip end of said ink supply needle for communicating to said throughholes of said ink supply needle.

69. The ink-jet recording apparatus of claim 42, wherein each of said holes in the tip end of the wall of the ink supply needle is dimensioned to form an ink meniscus when the ink supply cartridge is removed from the ink supply needle.

* * * * *

UNITED STATES PATENT AND TRADEMARK OFFICE

CERTIFICATE OF CORRECTION

PATENT NO. : 5,576,749

DATED : November 19, 1996

INVENTOR(S) : Mochizuki, et. al.

It is certified that error appears in the above-identified patent and that said Letters Patent is hereby corrected as shown below:

ON THE TITLE PAGE, item

[75] Inventors: Seiji Mochizuki; Kazuhisa Kawakami; Masahiro Nakamura; Keiichi Ohshima; Masanori Yoshida, all of Suwa, Japan

[*] Notice: The term of this patent shall not extend beyond the expiration date of Pat. No. 5,488,401.

[30] Foreign Application Priority Data

| | | |
|---|---|---|
| Jan. 30, 1990 [JP] | Japan..... | 2-21022 |
| Mar. 20, 1990 [JP] | Japan..... | 2-70318 |
| Nov. 29, 1990 [JP] | Japan..... | 2-332640 |
| Jan. 28, 1992 [JP] | Japan..... | 4-12834 |
| Feb. 19, 1992 [JP] | Japan..... | 4-32226 |
| Mar. 16, 1992 [JP] | Japan..... | 4-58151 |
| Jun. 26, 1992 [JP] | Japan..... | 4-193402 |

Signed and Sealed this

Twenty-first Day of September, 1999

*Attest:*

Q. TODD DICKINSON

*Attesting Officer*

*Acting Commissioner of Patents and Trademarks*